United States Patent [19]

Booth

[11] 4,219,710

[45] Aug. 26, 1980

[54] PRESSURE CHANGE RESPONSIVE SENSOR AND RELATED VACUUM OPERABLE SWITCH ASSEMBLY

[75] Inventor: Robert G. Booth, Oakland, Calif.

[73] Assignee: Stop Alert Corporation, Oakland, Calif.

[21] Appl. No.: 677,281

[22] Filed: Apr. 15, 1976

Related U.S. Application Data

[63] Continuation-in-part of Ser. No. 440,831, Feb. 8, 1974.

[51] Int. Cl.[2] ..... H01H 35/34

[52] U.S. Cl. ..... 200/81 R; 200/83 Q; 340/71

[58] Field of Search ..... 200/82 D, 83 A, 83 Q, 200/83 S, 83 T, 83 J, 84 B; 73/269, 270, 271, 406; 251/214, 331; 340/52 C, 71, 240

[56] References Cited

U.S. PATENT DOCUMENTS

| | | | |
|---|---|---|---|
| 3,005,888 | 10/1961 | Putz | 200/83 Q |
| 3,372,372 | 3/1968 | Carpenter | 200/83 S |
| 3,639,898 | 2/1972 | Booth | 200/83 Q |
| 3,733,449 | 5/1973 | Parker | 200/83 Q |
| 3,816,685 | 6/1974 | Fiore | 200/83 S |

*Primary Examiner*—Gerald P. Tolin

[57] ABSTRACT

A pressure change responsive sensor and related vacuum operable switch assembly capable of operation from the manifold of an internal combustion engine to activate a signal in anticipation of the application of the brakes of an automobile. The vacuum operable switch assembly is an improvement on the applicant's U.S. Pat. No. 3,639,898 for Differential Pressure Control System And Switch Means Therefor, and is capable of adjustment to function with internal combustion engines having different manifold vacuum characteristics.

3 Claims, 3 Drawing Figures

PRESSURE CHANGE RESPONSIVE SENSOR AND RELATED VACUUM OPERABLE SWITCH ASSEMBLY

This application is a continuation-in-part of Ser. No. 440,831, filed Feb. 2, 1974.

My invention relates to, in general, a pressure change sensor and more particularly to a vacuum operable switch assembly and system which is an improvement on the subject matter of my earlier U.S. Pat. No. 3,639,898 of Feb. 1, 1972 for DIFFERENTIAL PRESSURE CONTROL SYSTEM AND SWITCH MEANS THEREFOR, where the invention was an embodiment designed for use in the brake system of an automobile, where it responded to vacuum developed in the manifold of the internal combustion engine above a threshold value representative of an emergency situation, as brought on by the rapid removal at one's foot from the gas pedal in anticipation of applying the brakes.

In the embodiment as illustrated and described in my aforementioned patent, the threshold value at which the device responds is determined by a stressed diaphragm in the switch assembly and when this threshold value is reached, the diaphragm responds and exposes a port to a switch chamber, to such source of vacuum, causing a weight, preferably in the form of a ball, to lift off from a switch, which it normally holds open, to permit such switch to close a circuit to the brake light, the ball in the mean time, functioning as a vacuum responsive valve to close the port which the stressed diaphragm had just exposed. A delay in the dropping of the weight to open the switch, maintains the light until the brake switch can take over.

Different makes of automobiles develop different vacuum characteristics in the manifold under like conditions of rapid deceleration, as one quickly removes his foot from the gas pedal in anticipation of applying the brakes, and accordingly, the diaphragm which responds to the vacuum thus developed in the manifold above a predetermined threshold value, had to be designed in advance to match the vacuum conditions in the manifold of the engine with which it was to be used. While one setting might satisfy the requirements of approximately ninety percent of cars on the market, different settings would be required to meet the requirements of the remaining cars. Also, it has been found that subsequent development of bad valves or poor timing could so adversely affect manifold vacuum conditions as to render the device inactive to perform its intended function.

Aside from this, the ball, in striking the wall surface surrounding the port, might react to the initial impact and settled into port closing position only after a series of subsequently diminishing impacts.

The present improvement upon the above subject matter of my earlier patent, has among its objects (1) To provide a novel and improved pressure change sensor;

(2) To provide a novel and improved pressure change sensor in a vacuum operable switch assembly and system, adapted to operate a signal in anticipation of the application of the brakes of an automobile;

(3) To provide a novel and improved brake signal system capable of being adjusted to respond to internal combustion engines having different manifold vacuum characteristics;

(4) To provide a novel and improved brake signal system which is reliable in operation;

Additional objects of my invention will be brought out in the following description of a preferred embodiment of the same, taken in conjunction with the accompanying drawings where FIG. 1 is a plan view of the vacuum operable switch assembly of the present invention;

Figure 1:
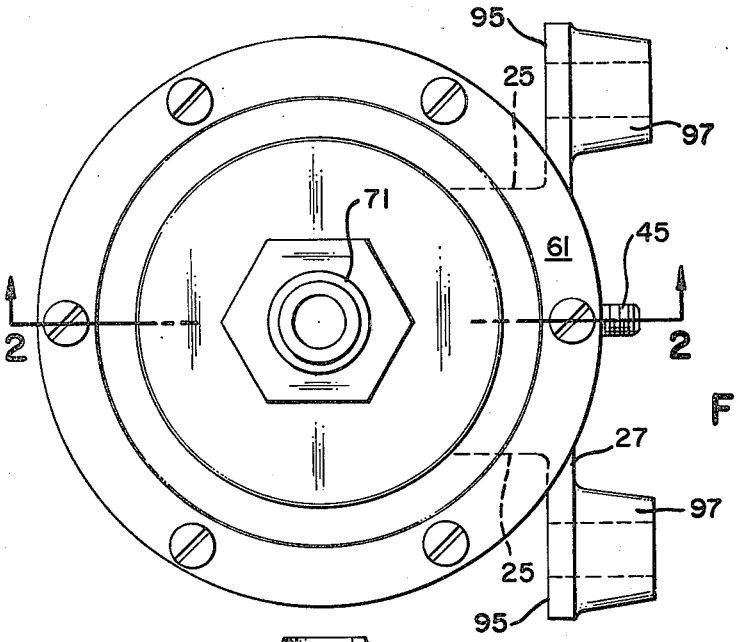
Figure 2:
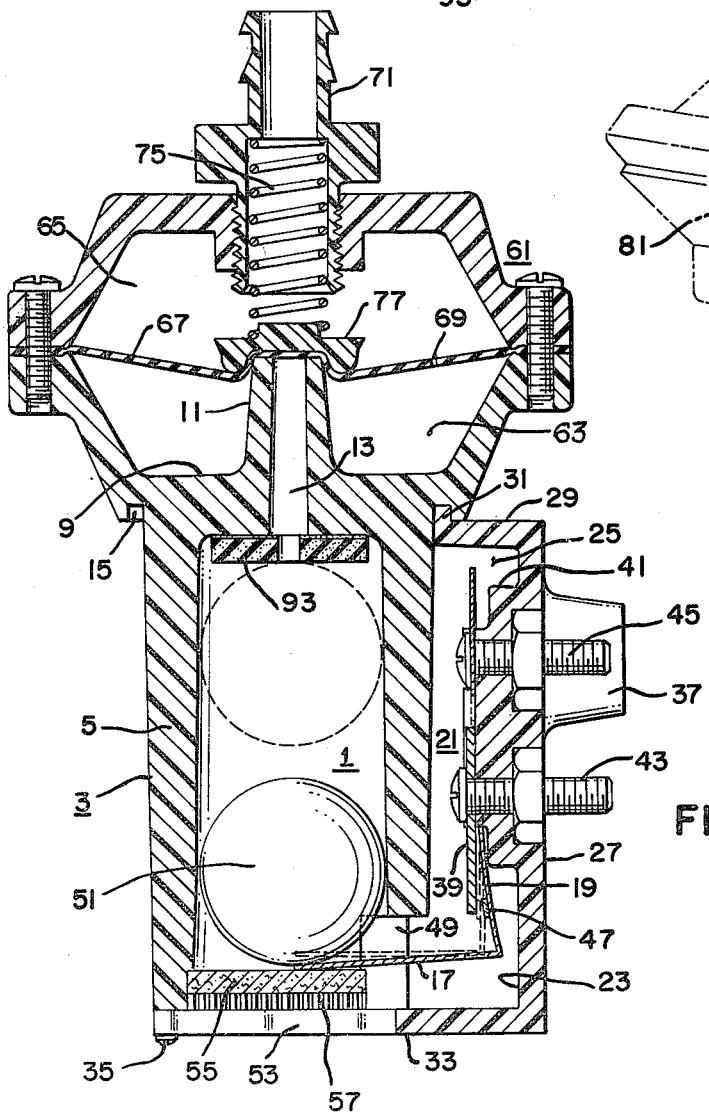
FIG. 2 is a view in section taken in the plane 2—2 of FIG. 1.
Figure 3:
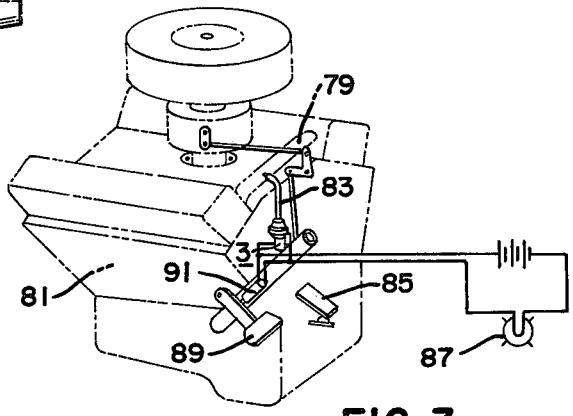
FIG. 3 is a view depicting the application of such vacuum operable switch assembly in conjunction with a brake signal system of an auto.

Referring to the drawings for details of my improved vacuum operable switch assembly in its preferred form, the same involves a switch assembly 1 comprising a housing 3 including a cylindrical wall 5 forming a chamber open at its bottom end, this cylindrical wall being at its other end by an end wall 9 having a nipple 11 extending centrally therefrom, with a passageway 13 from the chamber through the nipple, axially thereof. This end wall extends slightly beyond the cylindrical wall, where it is undercut to provide a channel 15.

Extending at least partially across the open end of the cylindrical chamber is the actuating arm or lever 17 constituting a portion of a flexible contact component 19 of a switch 21 supported externally of the chamber, within a housing extension 23 attached thereto and forming part of the housing 3.

Such housing extension includes a pair of side walls 25 spanned by a connecting wall 27, the spacing between said side walls approaching the outside diameter of the cylindrical wall to enable the housing extension to straddle the cylindrical chamber, to which it is maintained by a top wall 29 having an arcuate edge conforming to and engaging the cylindrical wall and held thereto by an upwardly directed arcuate flange or rib 31 inserted into the channel 15. A bottom wall 33 extends across the open end of the cylindrical chamber and is anchored to the lower edge of the chamber wall appropriate screws 35.

The switch 21 involves a second or rigid contact 39, which together with the flexible contact component mounted on a swtich block 41 formed integral with the wall 27, by screws extending through and beyond the wall to provide terminals 43 and 45 of the switch.

The flexible contact component 19 of thin spring sheet metal, preferably of copper affixed to the switch block, above the second contact, and extends around and terminates beneath the rigid contact, such first contact component including a contact button 47 which is normally spring biased into engagement with the rigid contact by the resiliency of the flexible contact component.

The actuating arm or lever 17 is a right angle extension of the flexible contact component and enters the chamber through an edge slot 49 in the cylindrical wall, where it may respond to pressure and open the normally engaging contacts of the switch.

Such pressure is normally applied by a weight, preferably in the form of a ball 51 of sufficient weight, and of a diameter approaching that of the chamber, as the ball, in the operation of the device, must respond to a reduction in pressure or creation of a condition of vacuum above it.

This requires admission to atmosphere below the ball as it rises, and this is provided for by a slot 53 in the bottom wall of the housing extension. To preclude admission of dust or other foreign matter, which might adversely effect operation, a filter pad 55 is installed in the bottom of the chamber and backed up by a screen 57.

Development of a vacuum condition in the chamber above the ball to effect actuation of the ball, is realized by coupling the ball chamber to a source of subatmospheric pressure, the source depending upon the use to which the device is put.

Such coupling is by way of a diaphragm chamber 61 at the upper end of the cylinder chamber and which is formed by a lower section 63 integral with the end wall of the cylindrical chamber, and capped by an upper section 65, with a diaphragm 67 clamped between the two sections, which diaphragm might be either in normally spaced relationship to the end of the nipple 11, or in light pressure contact with the nipple. A leak hole 69 in the diaphragm places the upper and lower sections of the diaphragm chamber in flow communication with each other via a flow resistance path.

Centrally threaded into the upper section of the diaphragm chamber is a flow fitting or coupling 71, and this is provided with an internal shoulder against which to anchor one end of a compression spring 75, installed in pressure engagement against the diaphragm via a recessed pressure applicator 77. A spring is selected which, in the absence of any other forces, will, by reason of pressure exerted by it, stress the diaphragm against the nipple and seal off the nipple passageway 13, such pressure being adjustable through threading adjustment of the flow fitting.

In this connection, the recessed pressure applicator 77 offers important practical advantages in assuring a perfect seal, for it not only folds the diaphragm about the nipple, but without it, the nipple is apt to form a permanent recess in the diaphragm which could adversely affect its ability to subsequently seal about the nipple, particularly under the vacuum conditions to which it is exposed. The spring centering extension to the recessed pressure applicator, adds to the effectiveness to the applicator in its functions.

In the course of developing a vacuum in the upper section 65 of the diaphragm chamber, a differential pressure will develop across the diaphragm, the value of which will be a function of the flow resistance of the leak hole. When and if such differential pressure reaches a value sufficient to overcome the opposing spring pressure, it will lift the diaphragm from its sealing position across the nipple.

The tendency toward equalization of conditions in both sections of the diaphragm chamber by reason of the presence of the leak hole in the diaphragm, will bring about a reduction in pressure in the upper portion of the ball chamber to develop a differential pressure across the ball, which, if of a magnitude to overcome the weight of the ball, will cause it to suddenly rise into sealing position against the proximate end of the nipple passageway. At this stage, the pressure about the surface of the ball, except for the insignificant area covering the opening to the diaphragm chamber, will, due to inflow of air through the slot 53, approach equalization to the point that the differential pressure across the ball can no longer sustain the weight of the ball and the ball will begin to slowly drop and upon reaching the switch, will re-establish the open condition thereof.

This sequence will occur, as when the device is coupled to the manifold 79 of an internal combustion engine 81 of an automobile. To effect such coupling, a hose 83 is affixed at one end to the flow coupling, and at its other end, connected into the manifold of the engine, where it will be exposed to the varying conditions of sub-atmospheric pressure or vacuum developed during operation of the car, in response to varying degrees of withdrawal of foot pressure from the gas pedal 85.

The degree of vacuum increases rather sharply when the foot is quickly withdrawn in anticipation of applying the brakes to cope with an emergency condition. Though the rapidity of such withdrawal may vary with the operator, and conditions prompting such withdrawal to apply the brakes, the minimum degree of vacuum developed under such emergency conditions represents what may be termed the threshold value. Such threshold value may vary with different internal combustion engines.

The spring 75 is selected as to calibration so that within its range of adjustability, it will permit the diaphragm to respond to the threshold value of vacuum developed in a wide range of such internal combustion engines, and create the minimum predetermined differential pressure across the nipple sufficient, not only to raise the ball and permit closing of the switch to light a light 87, but also to enable the ball to close the passageway through the nipple, all before the foot can be transferred to the brake pedal 89.

By connecting the switch 21 in parallel with the conventional brake switch 91, the light 87 can be the conventional brake light which will thus be connected in circuit before the foot can be transferred to the brake pedal and depress the same, and the light will remain in circuit through the switch 21 until the delayed dropping of the ball again opens the switch. Such time delay is sufficient to permit application of the brake pedal and closing of the brake switch 91 to the brake light, whereby no interruption of the brake light will occur during the sequence involving withdrawal of the foot from the gas pedal to the application of the brakes. It will be appreciated that the time element involved in removing the foot from the gas pedal and applying it to the brake pedal could be but a fraction of a second and that the time delay referred to is very short, but this brief interval of time will afford a car behind, considerable additional feet of travel within which to stop, without a rear end collision.

To assure an effective sealing of the nipple passageway by the ball and avoid impact oscillations of the ball against the end of the passageway, a soft seat is affixed to the end wall, in the form of a pad 93 of material such as felt, rubber, cellular plastic . . . etc. in registry with the nipple passageway.

Whichever material is employed, it has been found to be quite important that it be of the open cell type, which, in the normal condition of the material, will enable it to breathe or permit air flow therethrough, but which, upon compression, will enable closing of such cells to effect sealing.

As the ball flies upward to close the passageway to the diaphragm chamber, it impacts the pad with sufficient force to compress it and close the cells in the area of contact.

As the vacuum condition in the lower section of the diaphragm chamber gradually approaches the atmospheric pressure condition prevailing in the ball chamber, the vacuum grip or differential pressure on the ball becomes less and less, ultimately permitting expansion of the open cell resilient material, thereby opening the cells, to more quickly minimize the differential pressure and bring about release of the ball, aided by such expansion of the resilient material.

Thus, the open cell resilient material, not only avoids impact oscillations of the ball as it rises to close the passageway to the diaphragm chamber, such material also functions as a valve means to perform a valving action.

The wall 27 of the housing extension can be used for mounting the device in an installation, and accordingly, this wall is formed with mounting wings 95 and included bosses 97 of a length exceeding that of the switch terminals 43, 45, the bosses having bolt openings axially thereof for mounting of the swith assembly to the fire wall of the automobile or other appropriate wall.

In general, what the described embodiment of the invention has accomplished is to provide a reliable operating device which can be matched, by adjustment, to function in response to any one of a range of vacuum conditions, but in its broadest aspects, the invention involves a sensor which is responsive to a rapid change in pressure to effect a control operation.

As depicted, the sensor is responsive to a sudden drop in pressure, but by installing the spring below the diaphragm or by placing the pressure coupling in the wall of the other half of the diaphragm chamber, the sensor can be made to respond to a sudden increase in pressure. The ball actuated switch may be replaced by other control means appropriate to the situation to be controlled. Thus the invention has wide applications, including for example, response to sudden loss of pressure in a submarine, emptying of a fuel tank, to effect switch over to a reserve tank as with crop dusters . . . etc.

I accordingly do not desire to be limited in my protection to the specific embodiment illustrated and described, except as may be necessitated by the prior art.

I claim:

1. A vacuum operable switch assembly comprising a housing, a switch, means in said housing normally maintaining said switch in a predetermined status, means responsive to an externally developed condition of reduced pressure for developing a predetermined condition of reduced pressure within said housing, said means for developing such predetermined condition of reduced pressure in said housing including a passageway connecting said means with the interior of said housing, said switch status maintaining means being responsive to such predetermined condition of reduced pressure, to change the status of said switch means and block said passageway, and resilient valve means between said switch status maintaining means and the proximate end of said passageway for absorbing impact of said switch status maintaining means and for facilitating reestablishment of communication between said passageway and the interior of said housing as said reduced pressure developing means is restored to its pre-responsive condition, said resilient valve means including open cell resilient material.

2. A vacuum operable switch assembly comprising a housing, a switch, means in said housing normally maintaining said switch in a predetermined status, means responsive to an externally developed condition of reduced pressure for developing a predetermined condition of reduced pressure within said housing, said means for developing such predetermined condition of reduced pressure in said housing including a passageway connecting said means with the interior of said housing, said switch status maintaining means being responsive to such predetermined condition of reduced pressure, to change the status of said switch means and block said passageway, and resilient valve means between said switch status maintaining means and the proximate end of said passageway for absorbing impact of said switch status maintaining means and for facilitating reestablishment of communication between said passageway and the interior of said housing as said reduced pressure developing means is restored to its pre-responsive condition, said resilient valve means including a pad of open cell resilient material, said pad having an opening therethrough and being affixed about the end of said passageway.

3. A pressure change responsive sensor comprising a diaphragm chamber, a diaphragm dividing said chamber into a first section and a second section, one of said sections having an inwardly extending nipple providing communication through a wall of said section, said diaphragm being capable of movement from a position in spaced relationship to said nipple to a position in engagement therewith to block communication through said wall, and vica versa from a position in engagement with said nipple to a position in spaced relationship thereto, to open communication through said wall, spring means normally pressuring said diaphragm in one of said positions, said spring means including a compression spring installed with one end in pressure engagement with said diaphragm via a pressure applicator to preclude permanent deformation of said diaphragm at point of engagement with said nipple, such as could occur in absence of such applicator, said pressure applicator having a recess facing said nipple whereby to cause said diaphragm, under pressure of said spring to fold about said nipple, and means for altering the condition in response to a rapid change in pressure in opposition to said spring means, to cause said diaphragm to shift to its other position, and means for adjusting the pressure applied by said spring means to said diaphragm.

* * * * *